US006116143A

United States Patent [19]

Scheffel

[11] Patent Number: 6,116,143

[45] Date of Patent: Sep. 12, 2000

[54] CONTROLLER FOR A FLUID CYLINDER

[75] Inventor: Gerd Scheffel, Korschenbroich, Germany

[73] Assignee: Parker Hannifin GmbH, Cologne, Germany

[21] Appl. No.: 09/214,346

[22] PCT Filed: Jul. 2, 1997

[86] PCT No.: PCT/DE97/01386

§ 371 Date: Jan. 4, 1999

§ 102(e) Date: Jan. 4, 1999

[87] PCT Pub. No.: WO98/01678

PCT Pub. Date: Jan. 15, 1998

[30] Foreign Application Priority Data

Jul. 5, 1996 [DE] Germany ..... 196 27 085

[51] Int. Cl.[7] ..... F15B 11/08

[52] U.S. Cl. ..... 91/436

[58] Field of Search ..... 91/436

[56] References Cited

U.S. PATENT DOCUMENTS

| | | | |
|---|---|---|---|
| 2,980,136 | 4/1961 | Krehbiel | 91/436 |
| 3,216,446 | 11/1965 | Schmiel | 91/436 X |
| 3,255,777 | 6/1966 | Rice et al. | 91/436 X |
| 3,262,467 | 7/1966 | Stacey | 91/436 X |
| 3,263,574 | 8/1966 | Tennis | 91/436 |
| 3,357,451 | 12/1967 | Tennis | 91/436 |
| 3,426,647 | 2/1969 | Martin et al. | 91/436 X |
| 3,613,711 | 10/1971 | Wilke | 91/436 X |
| 3,746,040 | 7/1973 | Paul | 91/436 X |
| 3,858,485 | 1/1975 | Rosaen et al. . | |
| 4,099,379 | 7/1978 | Budzich | 91/436 X |
| 4,122,677 | 10/1978 | Budzich | 91/436 X |
| 4,192,218 | 3/1980 | Yamamoto | 91/436 X |
| 4,290,449 | 9/1981 | Budzich | 91/436 X |
| 4,697,419 | 10/1987 | Jeffery et al. | 91/436 X |
| 4,840,111 | 6/1989 | Garnjost | 91/436 |
| 5,022,434 | 6/1991 | Tsukimoto | 91/436 X |
| 5,394,903 | 3/1995 | Tominaga | 91/436 X |

FOREIGN PATENT DOCUMENTS

| | | |
|---|---|---|
| 30 00 260 A1 | 7/1991 | Germany . |
| 4234647 | 1/1994 | Germany . |
| 2 199 115 | 6/1988 | United Kingdom . |

*Primary Examiner*—John E. Ryznic
*Attorney, Agent, or Firm*—John A. Molnar, Jr.

[57] ABSTRACT

A device is disclosed for controlling a double action working cylinder (10) having a piston (11) with a piston rod (12) on a single side by means of a multiple-way valve (19), in which the available forces are to be fully applied at the beginning of the extension of the piston rod (12) and the differential motion becomes effective after a fixed distance of displacement of the piston. The multiple-way valve (19) has seven connection openings (T1, A1, P, B1, A2, T2, B2) for driving the predetermined functions, which can be driven in the individual working position by means of a valve piston (20) provided with seven control edges (1–7).

26 Claims, 2 Drawing Sheets

CONTROLLER FOR A FLUID CYLINDER

BACKGROUND OF THE INVENTION

The invention relates to an apparatus for controlling a double-acting working cylinder having a piston with one-sided piston rod by means of a multiway valve, which supplies the working medium to one of the differently sized swept volumes of the working cylinder, respectively, and permits it to flow out of the other swept volume during the piston stroke. The multiway valve, which is designed in the manner of a piston valve, has a pump connection P, a connection A1 for an inflow and outflow line between the large swept volume of the working cylinder and the multiway valve, a connection B1 for an inflow and outflow line between the small swept volume of the working cylinder and the multiway valve, a connection A2 for a connecting line connected to the inflow and outflow line positioned between connection A1 and the large swept volume of the working cylinder, and two reservoir connections T1, T2. The valve piston of the multiway valve has at least five control edges disposed on ring collars and the connections P, A1, A2, B1, T1, T2 are disposed in such a way that as the piston is extended, to use the differential action of the working cylinder with rapid piston motion, the inflow and outflow line is connectable with connection A2 and, as the piston is retracted, connection A1 is connectable with T1 and connection A2 with T2.

DE 30 00 260 C2 describes an apparatus with the aforementioned characteristics. The circuit arrangement disclosed therein with an assignment of six connections in series of the multiway valve employed is intended on the one hand to permit travel of the working cylinder piston with differential action, i.e., with rapid piston stroke, and on the other hand to ensure as compact a structural design of the multiway valve as possible with uniform pressurization of the five control edges provided on the multiway valve with the same quantity of working medium in both travel directions of the piston of the working cylinder.

For this purpose, in the known apparatus, as the working cylinder piston is extended, the additional connection opening connected to the large swept volume of the working cylinder via the connecting line, is connected via an associated control edge, which controls only the flow of working medium passing through this connecting line, with the line acting as the outflow from the small swept volume. Simultaneously, via another control edge and thus independently from the flow path between the swept volumes of the working cylinder, the pump connection is connected with the inlet to the large swept volume of the working cylinder. At the same time, as the piston of the working cylinder is retracted, the connection with the reservoir can be established through an additional connection provided in the multiway valve.

In addition, the interposition of a separate directional control valve makes it possible on the one hand to adjust the forward motion of the working cylinder piston using the differential action of the cylinder, while on the other hand using the full force in the extended end position of the piston rod. For this purpose, in the extended position of the piston rod, the small swept volume of the working cylinder is connected to the reservoir, whereby in the corresponding switching position of the directional control valve, the pressure acting on the large area of the piston of the working cylinder is no longer counteracted by a pressure in the small swept volume of the working cylinder such that the holding force is doubled compared to the state existing during extension of the piston rod.

First, the known embodiment only addresses the switching that permits the full force to act when the piston rod is extended. Moreover, there is the particular disadvantage that the additional directional control valve adds complexity to the corresponding design of the control apparatus. This is particularly true because the directional control valve must be designed for the same rated quantity as the multiway valve, which serves for the main control of the working cylinder, since the addressed functional case of connecting the small swept volume with the reservoir requires the same flow of working medium to be directed through the directional control valve as through the multiway valve.

SUMMARY OF THE INVENTION

Thus, it is the object of the invention to make it possible in a control apparatus for a differential cylinder with the initially mentioned characteristics, while eliminating an additional directional control valve, to adjust the full force acting on the piston of the working cylinder even at the start of the extension motion of the piston rod and, if a predefined piston stroke in the working cylinder is exceeded, to adjust the differential motion with rapid piston motion.

The invention is based on the fact that an additional connection B2 is provided for an additional connecting line connected to the inflow and outflow line located between connection B1 and the small swept volume of the working cylinder and, to control the two connections of the working cylinders, seven control edges are formed on the valve piston and are assigned to the seven connections P, A1, A2, B1, B2, T1, T2 of the multiway valve such that, at the beginning of the extension motion of the piston rod, the inflow and outflow line connected to the small swept volume of the working cylinder is connected with a reservoir connection T1 or T2 and, after traveling past the valve-piston position corresponding to the set start of the differential motion effective over the rest of the extension motion of the piston rod upon reaching a predefined piston position within the working cylinder, the connection between the inflow and outflow line and the reservoir connection T1 or T2 is blocked and the connection between the inflow and outflow line and connection A2 is opened.

The advantage of the invention is that forming an additional seventh connection opening in the multiway valve itself and adapting the design of the valve piston to include seven control edges makes it possible to eliminate an additional directional control valve, since the function of the directional control valve, both with respect to forming an additional reservoir connection and with respect to the instant when the additional reservoir connection is blocked for the differential motion of the piston, is integrated in the multiway valve itself. While the prior art multiway valve has five control edges for controlling the two connections of the working cylinder, the multiway valve according to the invention is distinguished by seven control edges formed on the valve piston. These control edges become active, respectively, in three different valve-piston positions, namely in a first position during retraction of the piston rod and in a second and third position graduated over the path of the piston within the working cylinder during extension of the piston rod. This additional seventh connection opening increases the size of the multiway valve only insignificantly.

According to a first exemplary embodiment of the invention, the multiway valve has seven openings P, A1, A2, B1, B2, T1, T2, which communicate, respectively, with a ring channel. Starting at the non-blocked valve end, opening T1 leads to the reservoir, A1 to the large swept volume, P to the pump, B1 to the small swept volume, A2 to the connecting line, T2 to the reservoir, and B2 to the connecting line. In the central position of the valve piston, the ring collars are assigned in blocking function to each second opening A1, B1, A2 and the associated ring channel. In the central position of the valve piston, the outlying openings B2 are open to opening T2 and, during extension of the piston rod, upon reaching the valve-piston position corresponding to the predefined start of the differential motion, are blocked to opening T2 by the associated control edge. In the defined sequence of the connection openings in the multiway valve, the change in the switching of the connection openings required in the second and third valve-piston position over the path of the piston within the working cylinder is implemented, in particular, by initially connecting the small swept volume of the working cylinder with a reservoir connection via connection opening B2, while blocking this connection during extension of the piston rod at the instant when the start of the differential motion is reached.

An alternative embodiment of the multiway valve provides that the multiway valve has seven openings P, A1, A2, B1, B2, T1, T2 communicating, respectively, with a ring channel. In the central valve-piston position, the ring collars are assigned to each second opening and the associated ring channel. Starting at the non-blocked valve end, opening T1 leads to the reservoir, A1 to the large swept volume, P to the pump, B1 to the small swept volume, T2 to the reservoir, A2 to the connecting line, and B2 to the connecting line. The valve piston has four ring collars. In the central position of the valve piston, three of these ring collars are assigned in blocking function to openings A1, B1, A2 and the associated ring channel. The fourth piston collar is assigned to opening T2 and is arranged and designed in such a way that in the central valve-piston position, on the one hand, the opening T2 is open to connection B1 and, during extension of the piston rod, upon reaching the valve-piston position corresponding to the defined start of the differential motion, is blocked toward opening B1. On the other hand, in the valvepiston position corresponding to the retraction of the piston rod, the connection of openings T2 and A2 is open. This alternative embodiment is based on a changed sequence of the connection openings. This is why four ring collars are formed on the valve piston. The fourth ring collar is uniquely assigned to connection T2 and is designed in such a way that initially, an open connection between the small swept volume of the working cylinder and a reservoir connection is established via connection B1. As the valve piston shifts, this connection is blocked on reaching the start of the desired differential motion. At the same time, the fourth piston collar continues to leave open connection T2 in the direction of the neighboring connection A2 such that the eighth control edge, which is given per se with four ring collars, does not become functionally effective. Instead, this embodiment has also seven active control edges.

BRIEF DESCRIPTION OF THE DRAWINGS

The drawing depicts exemplary embodiments of the invention, which are described in further detail below.

DETAILED DESCRIPTION OF THE INVENTION

Figure 1:
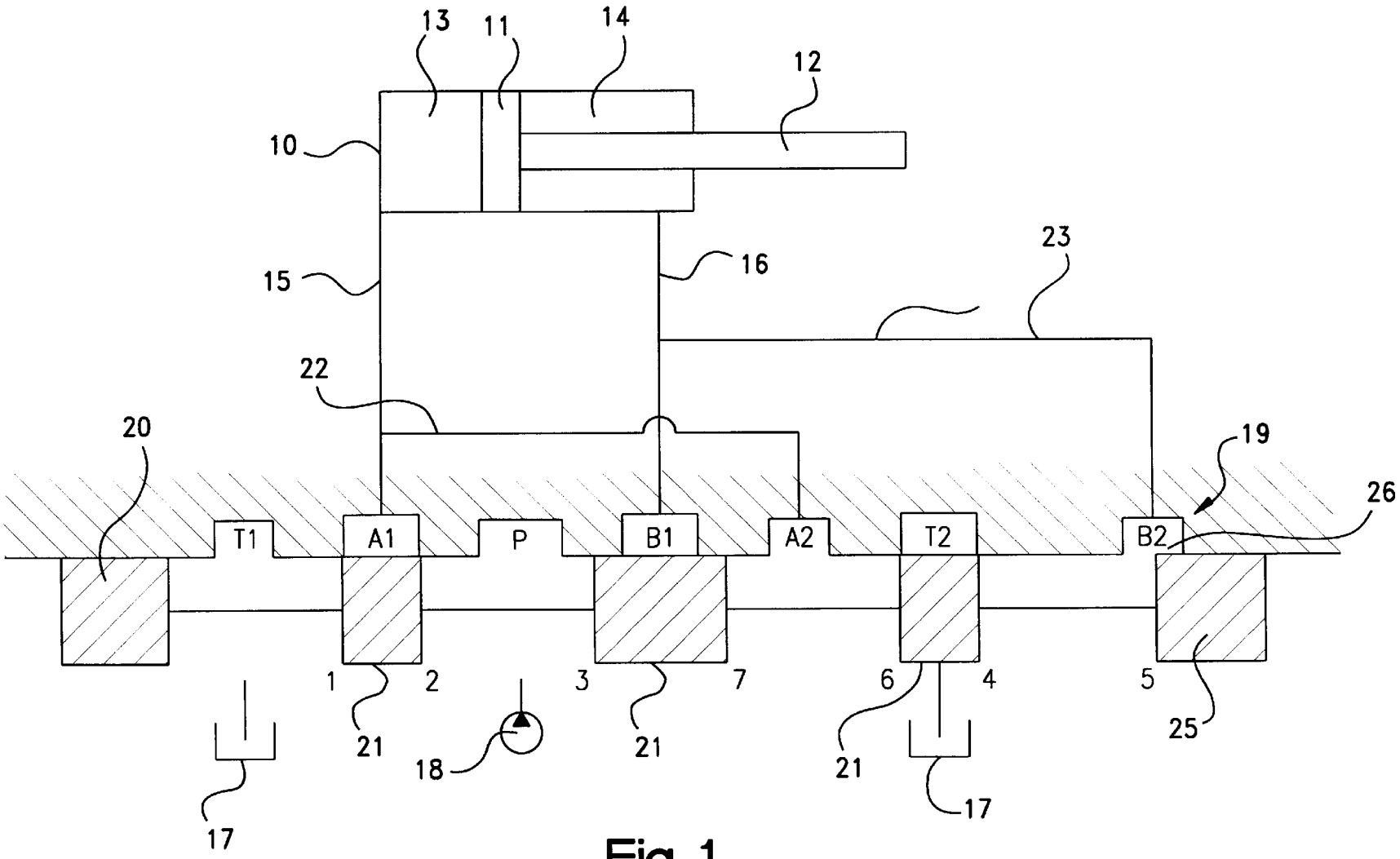
FIG. 1 shows a hydraulic circuit diagram for controlling a differential cylinder including the switching of the multiway valve, which is provided with seven connection openings.

For the following functional explanation, the drawing shows only the initial position to give a rough indication and does not take into account the scale of the openings and the ring collars. It is left to the person of average skill in the art to define the design layout and select the dimensions knowing the functional interrelationships intended by the invention.

The differential cylinder comprises a working cylinder 10 and a piston 11 sliding therein, which has different areas on its two sides, and a piston rod 12. Piston 11 separates the working cylinder 10 into a large swept volume 13 and a small swept volume 14. Each swept volume 13, 14 is provided at its end with a respective inflow and, simultaneously, outflow line 15 and 16 for the working medium hereinafter referred to as oil by way of example. The oil is located in a reservoir 17 (depicted in separate parts) and is assigned to a multiway valve 19 by means of a pump 18. From there, depending on the position of the valve piston 20, it flows to differential cylinder 10 or, through connected outlet lines, to reservoir 17. Elements that are not crucial for the understanding of the invention, such as pressure control valves, one-way restrictors, or the like, are not depicted.

In the embodiment shown in FIG. 1, multiway valve 19 has seven openings in a row, T1, A1, P, B1, T2, A2, B2. These openings are connected in this sequence with reservoir 17, inflow and outflow line 15 leading to the large swept volume, pump 18, inflow and outflow line 16 of a connecting line 22, which opens out into line 15, leading to the small swept volume 14, again reservoir 17, and an additional connecting line 23 opening out into inflow and outflow line 16. In the shown central position of valve piston 20 (zero position) within the indicated valve housing, pass into associated ring channels. In the zero position, these ring channels are blocked or open, respectively, by ring collars 21 formed on valve piston 20 in a manner to be described below.

In the depicted zero position, connections A1, B1, and T2 are blocked by the three ring collars 21 of valve piston 20. At the same time, end collar 25 of valve piston 20, which partially blocks connection B2, leaves open a flow path 26 to connection T2 blocked in zero position by the associated ring collar 21. The size of the flow path 26 effected by the lacking overlap of end collar 25 with connection B2 is a function of the length of the piston stroke of piston 11 within working cylinder 10, after the completion of which the differential motion of the piston 11 is to begin.

If valve piston 20 is displaced toward the left, on the one hand connections A1 and P are simultaneous unblocked or connected while on the other hand connection T2 is opened to connection B2, which in turn, due to the position of end collar 25, initially still leaves flow path 26 open. During this segment of the path traveled by valve piston 20, the pump pressurizes the large swept volume 13 of working cylinder 10 via connection A1 and inflow and outflow line 15. An open connection exists between the small swept volume 14 of working cylinder 10 and the reservoir connection T2 through inflow and outflow line 16 and connecting line 23 branching off therefrom and leading to connection B2, such that the pressure acting on the large area of piston 11 is no longer counteracted by a pressure in the small swept volume 14. Once the instant of the start of the differential motion determined by the valve piston design is reached during the piston stroke of piston 11 within working cylinder 10, the end collar 25 of valve piston 20 blocks connection B2 with the associated control edge 5. At the same time, connection B1 is connected with connection A2. As a result, the oil displaced from the small swept volume 14 as piston A1 continues to move is supplied via inflow and outflow line 16 and connection B1 to connection A2 and from there via connecting line 22 of the inflow and outflow line 15 to the large swept volume 13. Consequently, during the differential motion of piston 11 within working cylinder 10, pump 18 needs to deliver only half the quantity of working medium with respect to the large swept volume 13.

If valve piston 20, starting from the zero position depicted in FIG. 1, is displaced towards the right, it is also ensured that the delivery rate of pump 18 remains unchanged when the piston rod is retracted. On the supply side, this has the result of connecting connections P, B1 to the small swept volume 14 via inflow and outflow line 16, while the large swept volume 13 is connected with T1 via the inflow and outflow line and connection A1, which is blocked against P, and with T2 via connecting line 22 branching off from inflow and outflow line 15 and connection A2. To this extent, this results in a partitioning of the oil quantity flowing out of the large swept volume 13.

Figure 2:
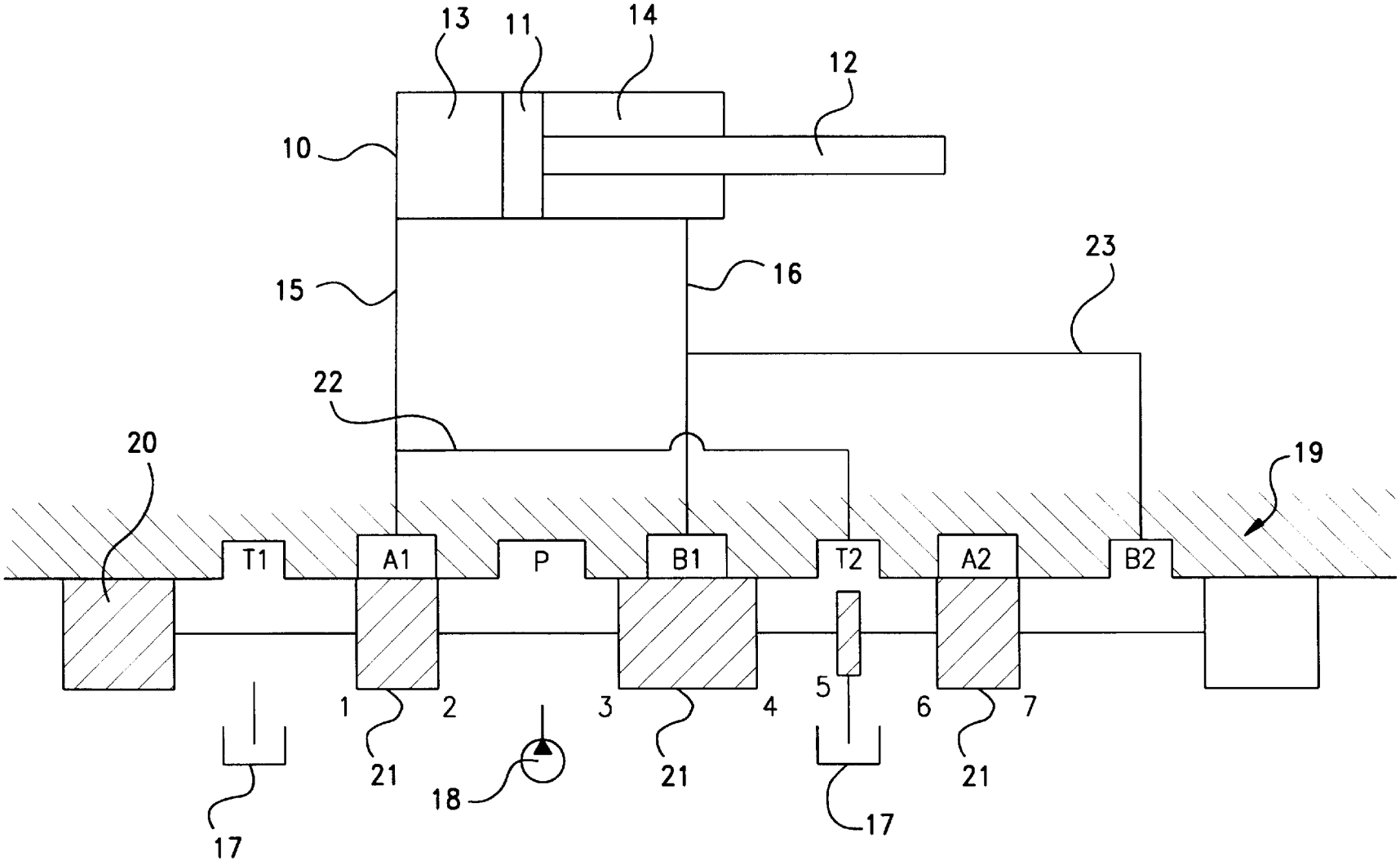
FIG. 2 shows the subject of FIG. 1 in a different embodiment.

The exemplary embodiment depicted in FIG. 2 is distinguished from the above described embodiment in that, in the sequence of the connecting lines, connections T2 and A2 are interchanged with respect to the embodiment depicted in FIG. 1. Thus, connection B1 is now next to T2 and connection A2 is next to B2. Due to this interchange of the connection openings, connections A1, B1, and A2 are now blocked in the depicted zero position by the three ring collars 21 of valve position 20. In addition, a fourth piston collar 24 is formed on valve piston 20 and assigned to connection T2 in such a way that in the central position of valve piston 20 (zero position), ring collar 24 effects the functionally equivalent open flow path 26 toward connection B1. At the same time, it is ensured that connection T2 is not blocked in the direction of connection A2 in any position of valve piston 20.

If valve piston 20 is shifted leftward in this embodiment, connections A1 and P are unblocked. At the same time, connection B1 is opened, which establishes the connection with T2 via the still open flow path 26. As described with respect to the embodiment according to FIG. 1, the pressurization of the large swept volume 13 of working cylinder 10 causes the piston rod to extend. At the start of this extension motion, the small swept volume 14 of working cylinder 10 is connected with connection T2 via line 16, connection B1, and the still open flow path 26 such that the small swept volume 14 of working cylinder 10 is pressureless. If valve piston 20 continues to shift leftward, the connection between B1 and T2 is blocked by control edge 5 of the fourth piston collar 24. At the same time, the connection between B2 and A2, which are positioned next to each other, is opened. As a result, the oil displaced from the small swept volume 14 during the extension of piston rod 12 is fed via line 16 and connecting line 23 branching off therefrom, the connected connections B2, A2, and connecting line 22 linked to A2 into the inflow and outflow line 15 to the large swept volume 13 of working cylinder 10.

Shifting valve piston 20 towards the right, starting from the central position of the valve piston according to FIG. 2, causes a connection of P, B1, through which the small swept volume 14 of working cylinder 10 is pressurized with oil. The oil flowing out of the large swept volume 13 of working cylinder 10 distributes itself through lines 15 and 22 to connections A1 and A2. From here, it can flow off to the reservoir via the connection with T1, T2 created by the position of valve piston 20, which is shifted toward the right. Since the fourth piston collar 24 is designed in such a way that connection T2 is not blocked in the direction of A2 in any position of valve piston 20, the desired connection from A2 to T2 is given.

The characteristics of the subject of this document disclosed in the above specification, the claims, the abstract, and the drawing can be significant either individually or in any combination for the implementation of the invention in its various embodiments.

What is claimed is:

1. A controller for a double-acting fluid cylinder having a working piston movable in a forward direction by a first fluid volume, and in a rearward direction by a second fluid volume, said cylinder being operable by said controller under a source of fluid pressure having an associated fluid reservoir, and said controller comprising a multi-position flow control valve comprising:

a plurality of sequentially arranged fluid ports including a pressure port (P) coupled in fluid communication with said source of fluid pressure, a first reversing port (A1) coupled in fluid communication with said first fluid volume of said cylinder and couplable in fluid communication with said port P, a second reversing-port (B1) coupled in fluid communication with said second fluid volume of said cylinder and couplable in fluid communication with said port P, a first by-pass port (A2) coupled in fluid communication with said first fluid volume of said cylinder and couplable in fluid communication with said port B1, a second by-pass port B2 coupled in fluid communication with said second fluid volume of said cylinder, a first reservoir port (T1) coupled in fluid communication with said reservoir and couplable in fluid communication with said port A1, and a second reservoir port (T2) coupled in fluid communication with said reservoir and couplable in fluid communication with said port B2; and a valve positioner having a plurality of valve elements including, in series, a first valve element, a second valve element, a third valve element, and a fourth valve element, whereby said valve positioner is displaceable from a null position wherein said port A1 is blocked by said first valve element, said port B1 is blocked by said second valve element, and said port T2 is blocked by said third valve element, to a first control position wherein said first valve element is displaced from said port A1 opening said port A1 in fluid communication with said port P admitting fluid pressure to said first fluid volume of said cylinder moving said working piston in said forward direction, said fourth valve element is at least partially displaced from said port B2 opening said port B2, and said third valve element is displaced from said port T2 opening said port T2 in fluid communication with said port B2 admitting fluid displaced from said second fluid volume into said reservoir, and whereby said valve positioner is further displaceable from said first control position to a second control position wherein said second valve element is displaced from said port B1 opening said port B1 in fluid communication with said port A2 admitting fluid displaced from said second fluid volume into said first fluid volume, and said port B2 is blocked by said fourth valve element closing fluid communication between said port B2 and said port T2.

2. The controller of claim 1 wherein in said null position said fourth valve element is at least partially displaced from said port B2 opening said port B2.

3. The controller of claim 1 wherein said port A2 further is couplable in fluid communication with said port T2, and wherein said valve positioner further is displaceable from said null position to a third control position wherein said second valve element is displaced from said port B1 opening said port B1 in fluid communication with said port P admitting fluid pressure to said second fluid volume of said cylinder moving said working piston in said rearward direction, said first valve element is displaced from said port A1 opening said port A1 in fluid communication with said port T1 admitting a first partitioned quantity of fluid displaced from said first fluid volume into said reservoir, and said third valve element is displaced from said port T2 opening said port T2 in fluid communication with said port A2 admitting a second partitioned quantity of fluid displaced from said first fluid volume of said cylinder into said reservoir.

4. The controller of claim 1 wherein said control valve further comprises a valve channel, each of said fluid ports opening in linear succession into fluid communication with said valve channel, and said valve positioner being configured as a valve piston which is slidably received within said valve channel for linear movement from said first control position to said second control position.

5. The controller of claim 4 wherein said fluid ports are arranged successively in the order of T1, A1, P, B1, A2, T2, and B2.

6. The controller of claim 1 wherein said first fluid volume of said cylinder is larger than said second fluid volume.

7. The controller of claim 1 wherein said working piston of said cylinder defines a first area on the side of said first fluid volume and a second area on the side of said second fluid volume, said first area being larger than said second area.

8. A fluid power system comprising:

a double-acting fluid cylinder having a working piston movable in a forward direction by a first fluid volume, and in a rearward direction by a second fluid volume;

a fluid pressure source for providing working fluid pressure to said cylinder;

a fluid reservoir for supplying working fluid to said fluid pressure source; and a controller for operating said cylinder under said working fluid pressure, said controller comprising a multi-position flow control valve comprising:

a plurality of sequentially arranged fluid ports including a pressure port (P) coupled in fluid communication with said source of fluid pressure, a first reversing port (A1) coupled in fluid communication with said first fluid volume of said cylinder and couplable in fluid communication with said port P, a second reversing port (B1) coupled in fluid communication with said second fluid volume of said cylinder and couplable in fluid communication with said port P, a first by-pass port (A2) coupled in fluid communication with said first fluid volume of said cylinder and couplable in fluid communication with said port B1, a second by-pass port B2 coupled in fluid communication with said second fluid volume of said cylinder, a first reservoir port (T1) coupled in fluid communication with said reservoir and couplable in fluid communication with said port A1, and a second reservoir port (T2) coupled in fluid communication with said reservoir and couplable in fluid communication with said port B2; and a valve positioner having a plurality of valve elements including, in series, a first valve element, a second valve element, a third valve element, and a fourth valve element, whereby said valve positioner is displaceable from a null position wherein said port A1 is blocked by said first valve element, said port B1 is blocked by said second valve element, and said port T2 is blocked by said third valve element, to a first control position wherein said first valve element is displaced from said port A1 opening said port A1 in fluid communication with said port P admitting fluid pressure to said first fluid volume of said cylinder moving said working piston in said forward direction, said fourth valve element is at least partially displaced from said port B2 opening said port B2, and said third valve element is displaced from said port T2 opening said port T2 in fluid communication with said port B2 admitting fluid displaced from said second fluid volume into said reservoir, and whereby said valve positioner is further displaceable from said first control position to a second control position wherein said second valve element is displaced from said port B1 opening said port B1 in fluid communication with said port A2 admitting fluid displaced from said second fluid volume into said first fluid volume, and said port B2 is blocked by said fourth valve element closing fluid communication between said port B2 and said port T2.

9. The fluid power system of claim 8 wherein in said null position of said flow control valve said fourth valve element of said valve positioner is at least partially displaced from said port B2 opening said port B2.

10. The fluid power system of claim 8 wherein said port A2 of said flow control valve further is couplable in fluid communication with said port T2, and wherein said valve positioner further is displaceable from said null position to a third control position wherein said second valve element is displaced from said port B1 opening said port B1 in fluid communication with said port P admitting fluid pressure to said second fluid volume of said cylinder moving said working piston in said rearward direction, said first valve element is displaced from said port A1 opening said port A1 in fluid communication with said port T1 admitting a first partitioned quantity of fluid displaced from said first fluid volume into said reservoir, and said third valve element is displaced from said port T2 opening said port T2 in fluid communication with said port A2 admitting a second partitioned quantity of fluid displaced from said first fluid volume of said cylinder into said reservoir.

11. The fluid power system of claim 8 wherein said control valve further comprises a valve channel, each of said fluid ports opening in linear succession into fluid communication with said valve channel, and said valve positioner being configured as a valve piston which is slidably received within said valve channel for linear movement from said first control position to said second control position.

12. The fluid power system of claim 11 wherein said fluid ports are arranged successively in the order of T1, A1, P, B1, A2, T2, and B2.

13. The fluid power system of claim 8 wherein said first fluid volume of said cylinder is larger than said second fluid volume.

14. The fluid power system of claim 8 wherein said working piston of said cylinder defines a first area on the side of said first fluid volume and a second area on the side of said second fluid volume, said first area being larger than said second area.

15. A controller for a double-acting fluid cylinder having a working piston movable in a forward direction by a first fluid volume, and in a rearward direction by a second fluid volume, said cylinder being operable by said controller under a source of fluid pressure having an associated fluid reservoir, and said controller comprising a multi-position flow control valve comprising:

a plurality of sequentially arranged fluid ports including a pressure port (P) coupled in fluid communication with said source of fluid pressure, a first reversing port (A1) coupled in fluid communication with said first fluid volume of said cylinder and couplable in fluid communication with said port P, a second reversing port (B1) coupled in fluid communication with said second fluid volume of said cylinder and couplable in fluid communication with said port P, a first by-pass port (A2) coupled in fluid communication with said first fluid volume of said cylinder, a second by-pass port B2 coupled in fluid communication with said second fluid volume of said cylinder and couplable in fluid communication with said port A2, a first reservoir port (T1) coupled in fluid communication with said reservoir and couplable in fluid communication with said port A1, and a second reservoir port (T2) coupled in fluid communication with said reservoir and couplable in fluid communication with said port B1; and a valve positioner having a plurality of valve elements including, in series, a first valve element, a second valve element, a third valve element, and a fourth valve element, whereby said valve positioner is displaceable from a null position wherein said port A1 is blocked by said first valve element, said port B1 is blocked by said second valve element, said third valve element is positioned to open said port T2, and said port A2 is blocked by said fourth valve element, to a first control position wherein said first valve element is displaced from said port A1 opening said port A1 in fluid communication with said port P admitting fluid pressure to said first fluid volume of said cylinder moving said working piston in said forward direction, and said second valve element is displaced from said port B1 opening said port B1 in fluid communication with said port T2 admitting fluid displaced from said second fluid volume into said reservoir, and p1 whereby said valve positioner is further displaceable from said first control position to a second control position wherein said third valve element is displaced from said port T2 closing fluid communication between said port T2 and said port B1, and said fourth valve element is displaced from said port A2 opening said port A2 in fluid communication with said port B2 admitting fluid displaced from said second fluid volume into said first fluid volume.

16. The controller of claim 15 wherein said port T2 is opened in a direction of fluid communication with said port A2, and wherein said valve positioner further is displaceable from said null position to a third control position wherein said second valve element is displaced from said port B1 opening said port B1 in fluid communication with said port P admitting fluid pressure to said second fluid volume of said cylinder moving said working piston in said rearward direction, said first valve element is displaced from said port A1 opening said port A1 in fluid communication with said port T1 admitting a first partitioned quantity of fluid displaced from said first fluid volume into said reservoir, and said fourth valve element is displaced from said port A2 opening said port A2 in fluid communication with said port T2 admitting a second partitioned quantity of fluid displaced from said first fluid volume of said cylinder into said reservoir.

17. The controller of claim 15 wherein said control valve further comprises a valve channel, each of said fluid ports opening in linear succession into fluid communication with said valve channel, and said valve positioner being configured as a valve piston which is slidably received within said valve channel for linear movement from said first control position to said second control position.

18. The controller of claim 17 wherein said fluid ports are arranged successively in the order of T1, A1, P, B1, T2, A2, and B2.

19. The controller of claim 15 wherein said first fluid volume of said cylinder is larger than said second fluid volume.

20. The controller of claim 15 wherein said working piston of said cylinder defines a first area on the side of said first fluid volume and a second area on the side of said second fluid volume, said first area being larger than said second area.

21. A fluid power system comprising:

a double-acting fluid cylinder having a working piston movable in a forward direction by a first fluid volume, and in a rearward direction by a second fluid volume;

a fluid pressure source for providing working fluid pressure to said cylinder;

a fluid reservoir for supplying working fluid to said fluid pressure source; and a controller for operating said cylinder under said working fluid pressure, said controller comprising a multi-position flow control valve comprising:

a plurality of sequentially arranged fluid ports including a pressure port (P) coupled in fluid communication with said source of fluid pressure, a first reversing port (A1) coupled in fluid communication with said first fluid volume of said cylinder and couplable in fluid communication with said port P, a second reversing port (B1) coupled in fluid communication with said second fluid volume of said cylinder and couplablc in fluid communication with said port P, a first by-pass port (A2) coupled in fluid communication with said first fluid volume of said cylinder, a second by-pass port B2 coupled in fluid communication with said second fluid volume of said cylinder and couplable in fluid communication with said port A2, a first reservoir port (T1) coupled in fluid communication with said reservoir and couplable in fluid communication with said port A1, and a second reservoir port (T2) coupled in fluid communication with said reservoir and couplable in fluid communication with said port B1; and a valve positioner having a plurality of valve elements including, in series, a first valve element, a second valve element, a third valve element, and a fourth valve element, whereby said valve positioner is displaceable from a null position wherein said port A1 is blocked by said first valve element, said port B1 is blocked by said second valve element, said third valve element is positioned to open said port T2, and said port A2 is blocked by said fourth valve element, to a first control position wherein said first valve element is displaced from said port A1 opening said port A1 in fluid communication with said port P admitting fluid pressure to said first fluid volume of said cylinder moving said working piston in said forward direction, and said second valve element is displaced from said port B1 opening said port B1 in fluid communication with said port T2 admitting fluid displaced from said second fluid volume into said reservoir, and whereby said valve positioner is further displaceable from said first control position to a second control position wherein said third valve element is displaced from said port T2 closing fluid communication between said port T2 and said port B1, and said fourth valve element is displaced from said port A2 opening said port A2 in fluid communication with said port B2 admitting fluid displaced from said second fluid volume into said first fluid volume.

22. The fluid power system of claim 21 wherein said port T2 of said control valve is opened in a direction of fluid communication with said port A2, and wherein said valve positioner further is displaceable from said null position to a third control position wherein said second valve element is displaced from said port B1 opening said port B1 in fluid communication with said port P admitting fluid pressure to said second fluid volume of said cylinder moving said working piston in said rearward direction, said first valve element is displaced from said port A1 opening said port A1 in fluid communication with said port T1 admitting a first partitioned quantity of fluid displaced from said first fluid volume into said reservoir, and said fourth valve element is displaced from said port A2 opening said port A2 in fluid communication with said port T2 admitting a second partitioned quantity of fluid displaced from said first fluid volume of said cylinder into said reservoir.

23. The fluid power system of claim 21 wherein said control valve further comprises a valve channel, each of said fluid ports opening in linear succession into fluid communication with said valve channel, and said valve positioner being configured as a valve piston which is slidably received within said valve channel for linear movement from said first control position to said second control position.

24. The fluid power system of claim 23 wherein said fluid ports are arranged successively in the order of T1, A1, P, B1, T2, A2, and B2.

25. The fluid power system of claim 21 wherein said first fluid volume of said cylinder is larger than said second fluid volume.

26. The fluid power system of claim 21 wherein said working piston of said cylinder defines a first area on the side of said first fluid volume and a second area on the side of said second fluid volume, said first area being larger than said second area.

* * * * *